US006764436B1

(12) United States Patent
Mazurek

(10) Patent No.: US 6,764,436 B1
(45) Date of Patent: Jul. 20, 2004

(54) METHOD AND APPARATUS FOR SQUARING CASES

(76) Inventor: Mark Stanley Mazurek, 145 W. Hattendorf Ave., Roselle, IL (US) 60172

( * ) Notice: Subject to any disclaimer, the term of this patent is extended or adjusted under 35 U.S.C. 154(b) by 0 days.

(21) Appl. No.: 10/340,907

(22) Filed: Jan. 11, 2003

(51) Int. Cl.[7] ..... B31B 01/92
(52) U.S. Cl. ..... 493/120; 493/122; 493/123
(58) Field of Search ..... 493/122, 123, 493/120, 125, 183, 180, 182

(56) References Cited

U.S. PATENT DOCUMENTS

| | | | | | |
|---|---|---|---|---|---|
| 2,289,820 | A | | 7/1942 | Ardell | |
| RE27,631 | E | | 5/1973 | Berney | |
| 3,739,696 | A | | 6/1973 | Pearson | |
| 3,814,000 | A | | 6/1974 | Heisler | |
| 3,935,798 | A | * | 2/1976 | Paxton | 493/84 |
| 4,163,414 | A | | 8/1979 | Bachman | |
| 4,194,442 | A | * | 3/1980 | Martelli | 493/316 |
| 4,197,790 | A | | 4/1980 | Dietrich | |
| 4,273,322 | A | * | 6/1981 | Ginther et al. | 271/149 |
| 4,285,679 | A | | 8/1981 | Wahle | |
| 4,439,174 | A | | 3/1984 | Derderian | |
| 4,627,830 | A | | 12/1986 | Smidt | |
| 4,632,666 | A | | 12/1986 | Ulrich | |
| 4,685,272 | A | * | 8/1987 | Kawai et al. | 53/389.1 |
| 4,976,672 | A | * | 12/1990 | Harrison et al. | 493/130 |
| 5,007,889 | A | * | 4/1991 | Wakabayashi et al. | 493/316 |
| 5,156,582 | A | | 10/1992 | Thompson | |
| 5,298,008 | A | | 3/1994 | Decker | |
| 5,704,196 | A | * | 1/1998 | Pazdernik et al. | 53/458 |
| 5,997,459 | A | * | 12/1999 | Kruger et al. | 493/441 |
| 6,309,335 | B1 | * | 10/2001 | Holton | 493/122 |

* cited by examiner

*Primary Examiner*—Eugene Kim

(57) ABSTRACT

A case is gripped by its side panel by suction cups mounted on a squaring arm and rotated out of a magazine into contact with a squaring rail, which forces the case into a squared configuration as the case rotates into position between two drive belts, one fixed, and one with a gate-like swinging section which is rotated open. The bottom minor flaps are then closed by minor flap folders as the swinging belt section rotates closed, gripping the case. The drive belts then convey the case out of the squaring area, over flap ploughs which close the bottom major flaps. The squaring arm, fixed drive belt, and rear minor flap folder are mounted to a carrier. The front minor flap folder and major flap ploughs are mounted to a second carrier. The adjustment mechanism of both carriers is coupled to the adjustment mechanism of the magazine height.

10 Claims, 7 Drawing Sheets

METHOD AND APPARATUS FOR SQUARING CASES

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates to the field of packaging machinery, particularly machines for erecting or squaring cases and folding the bottom flaps in preparation for filling and closing. The cases are typically shipping cases into which single or multiple articles are placed for storage and transport to retailers or end users. These machines typically contain a quantity of identical cases, held in a magazine, which are removed, squared, and transported, one at a time, out of the machine.

Known machinery of this type currently in use typically utilizes suction cups to grip the case, then extract it from the magazine and manipulate it into a squared configuration using various combinations of reciprocating linear and/or rotary motions. The bottom minor flaps are then closed by flap folding mechanisms. The bottom major flaps may also be closed by similar mechanisms, or by stationary ploughs which force the major flaps closed as the case is conveyed out of the squaring area. One common conveying means is a reciprocating carrier, traveling along a linear path. This carrier may contain the extracting and squaring means, and may drive the case from behind or by the gripped sides of the case. Another common conveying means consists of a pair of rotating side drive belts which the case is inserted between after it is squared.

There are generally two basic configurations for this type of machinery, determined by the path taken by the cases as they move through the machine. The first is an "L"-shaped configuration, wherein the case is extracted from the magazine and conveyed along a path at a ninety degree angle to the flow of cases from the magazine. The second is an "in-line" configuration, wherein the case is extracted from the magazine and conveyed along a path common to or along the same line as the flow of cases from the magazine. With this type of configuration, the cases "flow through" the machine.

These machines are adjustable to handle a variety of case sizes, within a specified range. There are usually several adjustments that must be made during a changeover from one case size to another. These adjustments include magazine height (to compensate for varying bottom flap length), left and right magazine side guide position, magazine case top support position, squaring mechanism position, bottom flap kicker positions, and conveying means side guide positions. These adjustments are typically made individually, using scales mounted on the mechanisms and measured dimensions of the case, or the case itself as a gauge. Thus, a typical case size changeover may involve as many as nine individual adjustments.

Examples of the previously described machines include the following U.S. Pat. Nos. Re. 27631; 4,439,174; 3,739,696; 4,627,830; 4,632,666; 4,285,679 and 5,156,582.

As can be seen in the prior art, many of the mechanisms used in current machines are complex and elaborate, making them more expensive to manufacture and difficult to adjust and maintain. These machines use some form of reciprocating linear motion in the squaring and/or conveying operations. As opposed to reciprocating rotary mechanisms, reciprocating linear mechanisms are typically more expensive to construct due to the cost of linear bearings and substantial structure required in order to achieve stability and reliability. Due to increased mass, reciprocating linear mechanisms typically require more area within the machine, more energy to operate, and are more limited in terms of operating speed than reciprocating rotary mechanisms.

Many of the prior art machines are of the "L" configuration, which typically occupies more floor space than the "in-line" configuration machine, and utilizes this floor space less efficiently. The "L" configuration also deems necessary the offering of left-hand and right-hand models to accommodate customers differing layout requirements.

As detailed earlier, most prior art machines have numerous adjustments which must be made individually, which leads to time-consuming and complicated changeovers. Additionally, the accuracy of these adjustments is difficult to achieve and replicate, which can mean "debugging" the machine after each changeover.

OBJECTS AND ADVANTAGES

The primary object of the invention is to provide a case erector that is mechanically simple, with the minimum number of moving parts.

Another object of the invention is to provide a case erector where simple rotary motions perform all the necessary functions.

Another object of the invention is to provide a case erector that is relatively inexpensive to manufacture.

A further object of the invention is to provide a case erector having the preferable "in-line" magazine configuration and a relatively small footprint.

Yet another object of the invention is to provide a case erector that allows for simple mechanical coupling of several changeover adjustments, meaning simpler changeovers with less steps and better accuracy.

Other objects and advantages of the present invention will become apparent from the following descriptions, taken in connection with the accompanying drawings, wherein, by way of illustration and example, an embodiment of the present invention is disclosed.

BRIEF SUMMARY OF THE INVENTION

In accordance with a preferred embodiment of the invention, there is disclosed a mechanism for squaring flattened case blanks, folding the bottom flaps and delivering them in preparation for use. A magazine section contains a plurality of flattened case blanks, each case blank having a first major side panel, a first outer folded corner adjacent to the first major side panel, a second outer folded corner on the opposite end of the case blank from the first outer folded corner, two bottom major flaps, and two bottom minor flaps. A pivotally mounted arm with suction cups attached grips the lead case blank by the first major side panel, leaving the remaining three side panels free to rotate about its four corners. A curved structure is mounted in the path of the rotating case blank in a position where it will making contact with the second outer folded corner. The curved structure is formed in such a manner that it causes the distance between the outer folded corners to gradually decrease as the case blank rotates. The case blank is forced into a squared configuration as it reaches 90 degrees of rotation.

The bottom minor flaps are then folded by flap kickers as the major side panels of the case are gripped between two drive belts, one stationary, and one with a gate-like swinging section. The drive belts convey the case over major flap ploughs, which close the bottom major flaps, and out of the machine.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
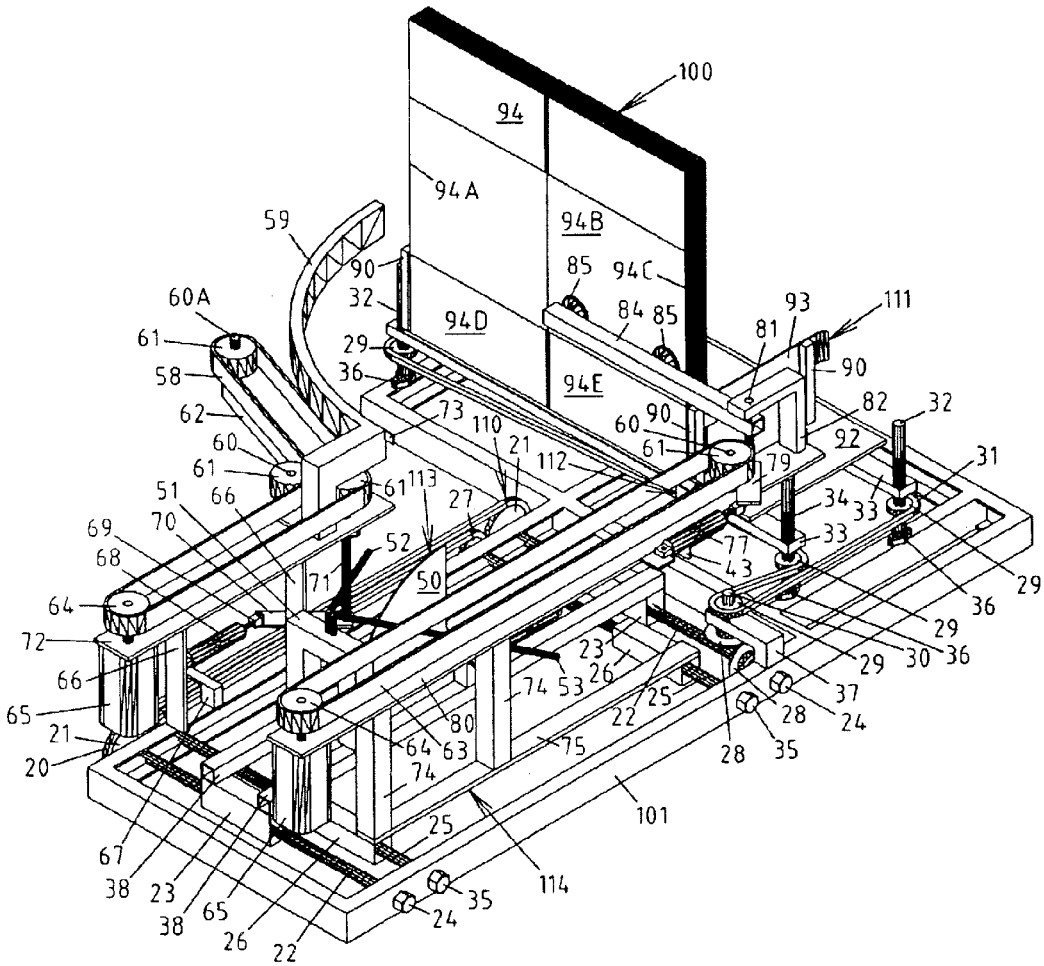
FIG. 1 is a perspective view of the invention.

Turning first to FIG. 1, there is shown a machine illustrating the preferred embodiment of the instant invention. A frame 101 has mounted upon it an adjuster assembly 110, a magazine assembly 111, a rear flap kicker assembly 112, a front flap kicker assembly 113, and a squaring and conveying assembly 114.

Figure 4A:
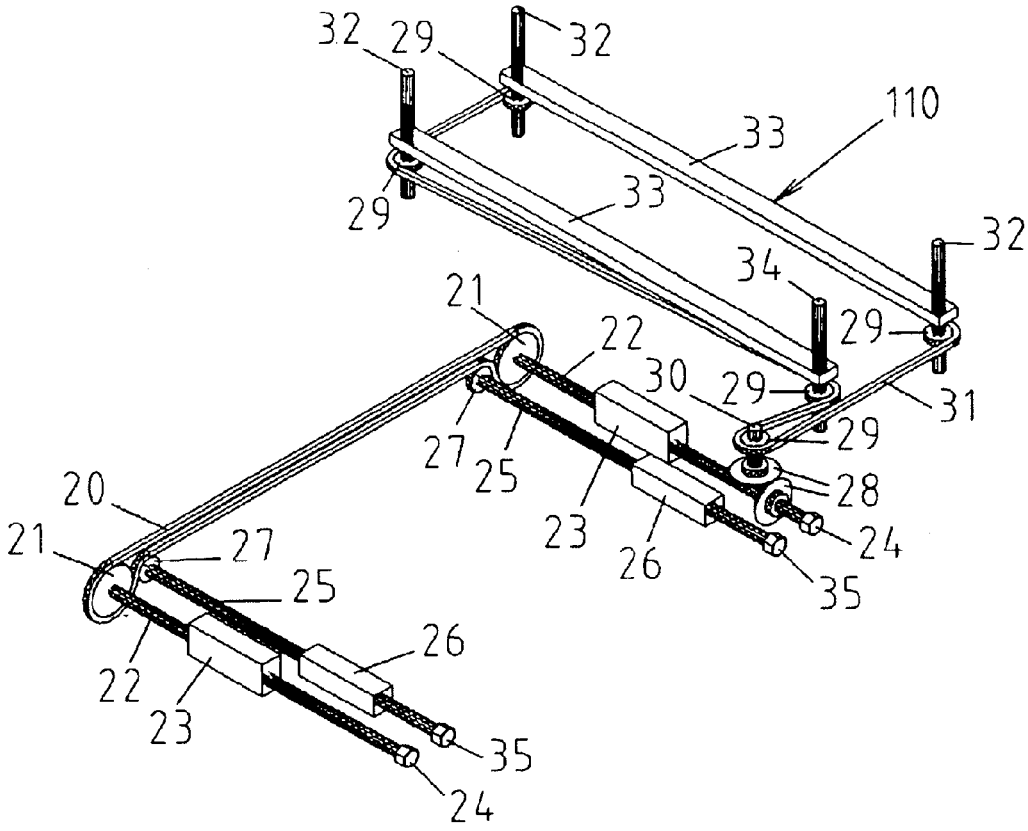
FIG. 4A is a detailed perspective view of the adjustment mechanisms of the invention.
Figure 4B:
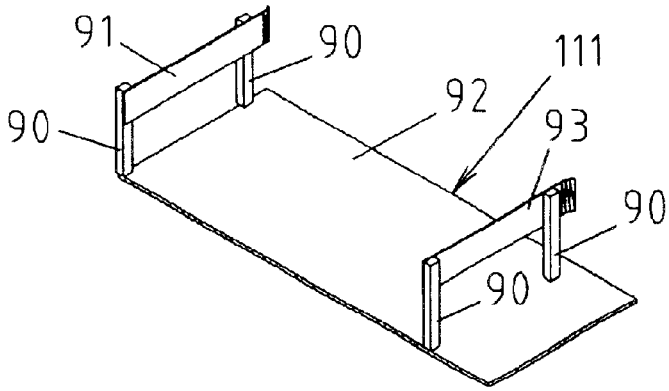
FIG. 4B is a detailed perspective view of the magazine section of the invention.

Turning to FIGS. 1 and 4B, there is shown a flattened case blank group 100, which consists of a plurality of flattened case blanks. A lead case blank 94 which has a minimum of a first outer folded corner 94C, second outer folded corner 94A, first major side panel 94B, bottom major flaps 94E, and bottom minor flaps 94D is positioned for processing. The case blank group 100 is contained in a magazine, well known in this field and functionally illustrated by the magazine assembly 111. A magazine case support plate 92 represents the support means of the case blank group 100. A right magazine side rail 91 represents a fixed case guide, which is attached to two magazine side rail supports 90, which are fixedly attached to the case support plate 92. A left magazine side rail 93 represents an adjustable case guide, which is attached to two magazine side rail supports 90, which are adjustably attached to the case support plate 92. In order for the magazine assembly 111 to accommodate cases of different widths and lengths, the left magazine side rail 93 is adjusted laterally towards or away from the right magazine side rail 91 via an adjustment mechanism (not shown). The case blank group 100 is typically driven forward by one of several types of feeding means well known in this field (not shown) as the lead case blank is removed.

Figure 5A:
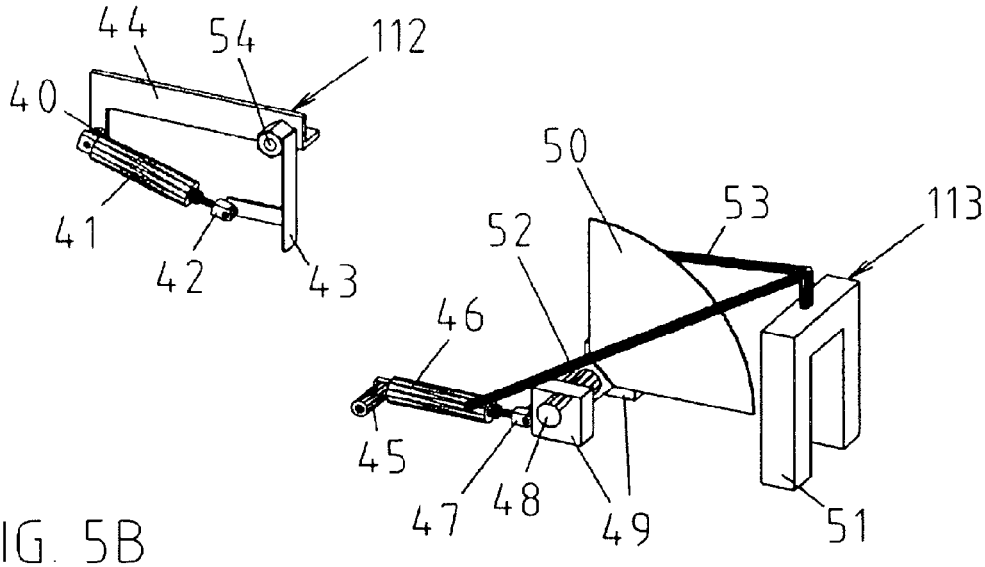
FIG. 5A is a detailed perspective view of the flap-folding mechanisms of the invention in their starting positions.
Figure 5B:
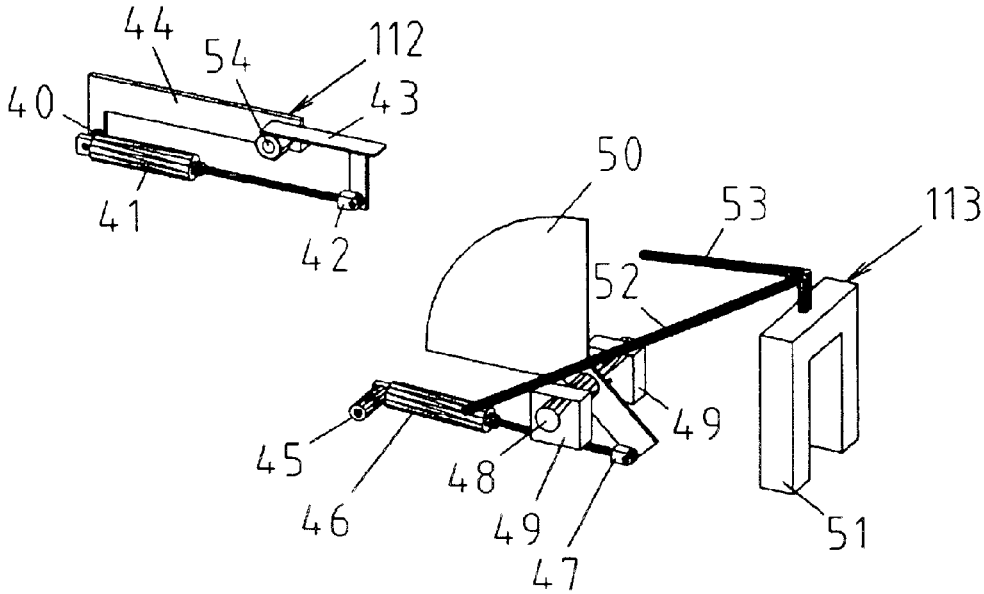
FIG. 5B is a detailed perspective view of the flap-folding mechanisms of the invention in their actuated or "flap-folded" positions.

Turning to FIGS. 5A and 5B, the rear flap kicker assembly 112 and front flap kicker assembly 113 can be seen in detail. FIG. 5A shows the assemblies in their starting positions, and FIG. 5B shows the assemblies in their actuated or "flap-folded" positions. The rear flap kicker assembly 112 is attached to the underside of a fixed belt horizontal support 80 via an adjustment mechanism (not shown) that allows it to be moved laterally towards or away from the squared case blank 94. The assembly 112 consists of a rear flap kicker 43, which is attached to and free to rotate about a rear kicker pivot shaft 54, which is attached to a rear kicker carrier 44. A rear kicker cylinder support 40 is attached to the rear kicker carrier 44 and a rear kicker air cylinder 41 is attached to the support 40 in a manner that allows it to pivot. The cylinder 41 has a rear kicker cylinder rod end 42 attached to it, which is attached to the kicker 43 in a manner that allows it to pivot. As the rod of the cylinder 41 extends, the kicker 43 is rotated upward about the shaft 54 until it reaches the position illustrated in FIG. 5B, wherein, as will be shown, it will have folded the rearward bottom minor flap 94D of the case being processed.

The front flap kicker assembly 113 consists of a front flap kicker 50, which has attached to it a front kicker pivot shaft 48, which is attached to and free to rotate within two front kicker support brackets 49, which are attached to two flap kicker carrier tubes 38 shown in FIG. 1. A front kicker cylinder support 45 is attached to one of the tubes 38, and a front kicker cylinder 46 is attached to the support 45 in a manner that allows it to pivot. The cylinder 46 has a front kicker cylinder rod end 47 attached to it, which is attached to the kicker 50 in a manner that allows it to pivot. As the rod of the cylinder 46 extends, the kicker 50 is rotated upward as its shaft 48 rotates within the brackets 49 until it reaches the position illustrated in FIG. 5B, wherein, as will be shown, it will have folded the forward bottom minor flap 94D of the case being processed.

A plough support bracket 51 is mounted on the tubes 38 and has a right flap plough 52 and a left flap plough 53 attached to it. The ploughs 52 and 53 are positioned to force the bottom major flaps 94E closed as the case is conveyed past them.

Figure 6A:
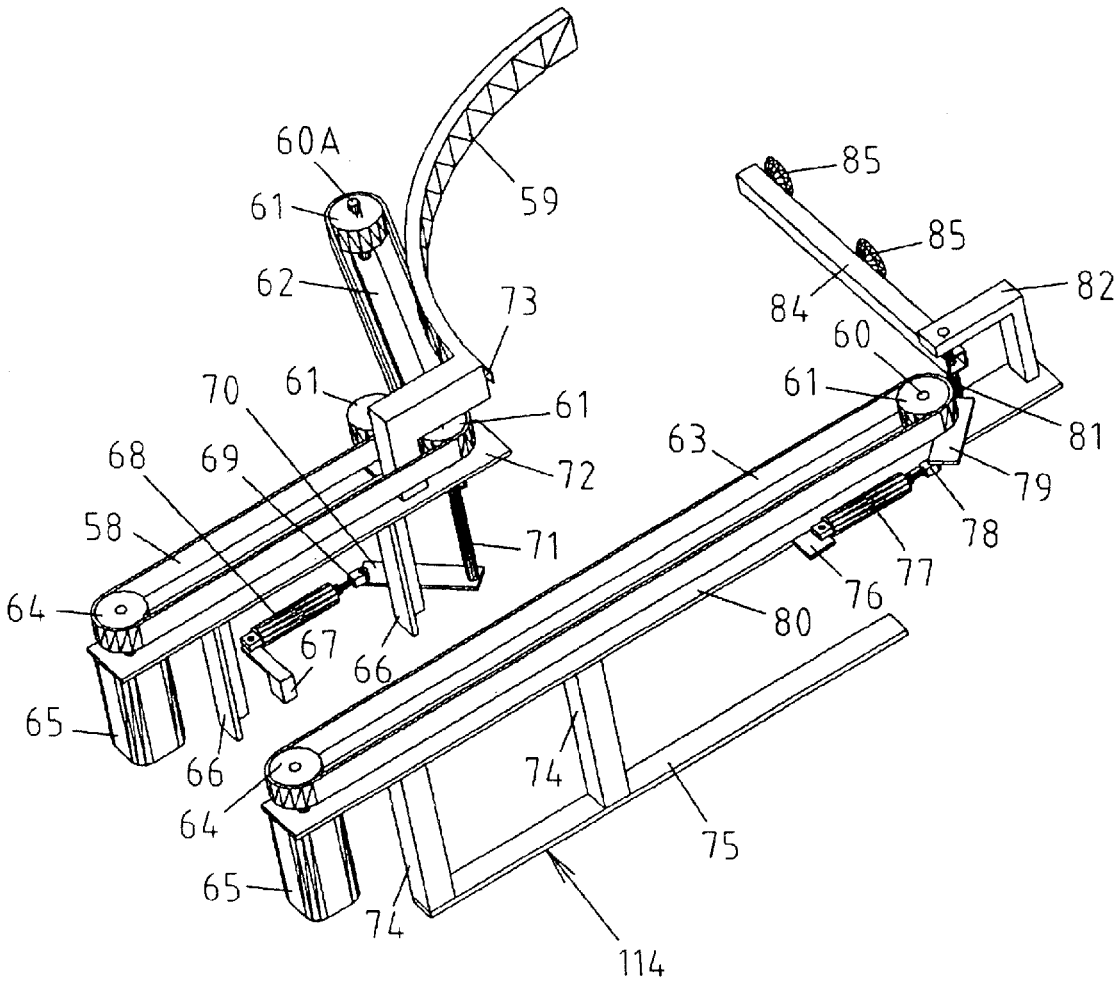
FIG. 6A is a detailed perspective view of the squaring arm and drive belt mechanisms of the invention in their starting positions.
Figure 7A:
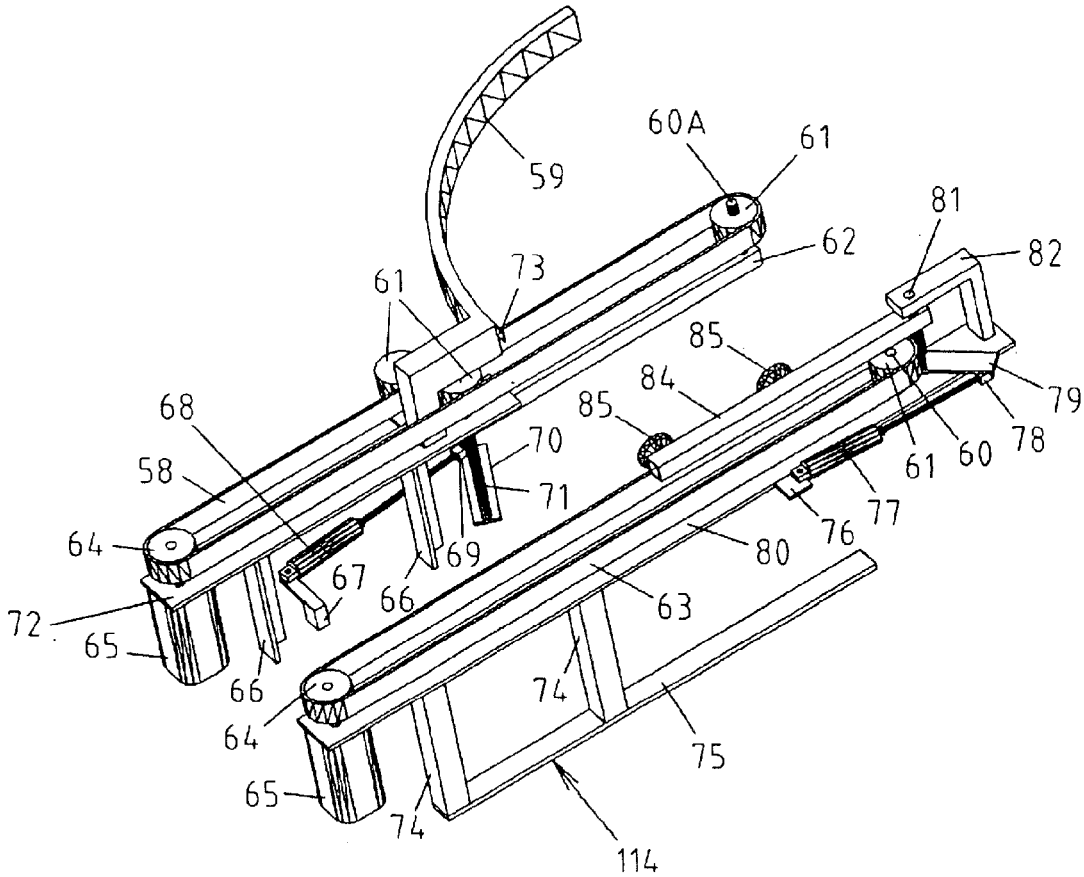
FIG. 7A is a detailed perspective view of the squaring arm and drive belt mechanisms of the invention in their actuated or "case-squared-and-gripped" positions.

Turning to FIGS. 6A and 7A, the squaring and conveying assembly 114 can be seen in detail. FIG. 6A shows the assembly in its starting position and FIG. 7A shows the assembly in its actuated or "case-squared-and-gripped" position.

A fixed belt support carrier 75 has attached to it two fixed belt vertical supports 74, to which the support 80 is attached. Mounted under one end of the support 80 is a motor, represented by a belt drive motor 65, which has a belt drive pulley 64 attached to its output shaft. Mounted on the end of the support 80, opposite the end to which the motor 65 is attached, is an idler pulley axle 60, which has an idler pulley 61 attached to it in a manner that allows it to rotate. A fixed case drive belt 63 is threaded around the pulleys 61 and 64, and rotates counterclockwise about them when driven by the motor 65.

The frame 101 has two swinging belt vertical supports 66 attached to it, to which a swinging belt horizontal support 72 is attached. Mounted under one end of the support 72 is a motor, represented by a belt drive motor 65, which has a belt drive pulley 64 attached to its output shaft. A swing arm support shaft 71 is attached to the support 72 in a manner that allows it to pivot. A belt swing arm 62 and a swing arm control arm 70 are attached to the shaft 71. A swing arm idler pulley axle 60A is mounted on the end of the arm 62, opposite the end which is attached to the shaft 71. An idler pulley axle 60 is mounted to the support 72 adjacent to the shaft 71. The axles 60, 60A, and the top end of shaft 71 each have an idler pulley 61 attached to them in a manner that allows the pulleys 61 to rotate. A swinging case drive belt 68 is threaded around the pulleys 61 and 64, and rotates clockwise about them when driven by the motor 65. A case squaring rail 59, which is a fixed curved member, is attached to the top of support 72, and has attached to it a case retention spring 73, which may be a flat piece of spring steel. Attached to the frame 101 is a swing arm cylinder support 67, which has a swing arm cylinder 68 attached to it in a manner that allows it to pivot. The cylinder 68 has a swing arm cylinder rod end 69 attached to it which is attached to the arm 70 in a manner that allows it to pivot. As the rod of the cylinder 68 extends, arm 70, shaft 71, arm 62, and all attached elements including the belt 58 are rotated clockwise about the axis of rotation of shaft 71 until they reach the position illustrated in FIG. 7A.

Attached to the support 80 is a squaring arm support bracket 82, to which a squaring arm pivot shaft 81 is attached in a pivotally mounted manner. The pivot shaft 81 has attached to it a squaring arm control arm 79 and a squaring arm 84, which has attached to it two suction cups 85. The suction cups 85 communicate with a vacuum source (not shown), possibly through a hose connected to the arm 84. Attached to the support 80 is a squaring arm cylinder support bracket 76, which has a squaring arm cylinder 77 attached to it in a manner that allows it to pivot. The cylinder 77 has a squaring arm cylinder rod end 78 attached to it, which is attached to the arm 79 in a manner that allows it to pivot. As the rod of the cylinder 77 extends, arm 79, shaft 81, arm 84, and cups 85 are rotated counterclockwise about the axis of rotation of shaft 81, until they've rotated 90 degrees to reach the position illustrated in FIG. 7A.

The cylinders 41, 46, 68, and 69 are of the pneumatically actuated type. The motors 65 may be of a servo type motor. These devices, as well as the means for controlling and synchronizing their operation (not shown) are all well known in this field.

Turning to FIGS. 1 and 4A, there is shown the adjuster assembly 110, which facilitates the simultaneous mechanically linked or coupled adjustment of the height of magazine assembly 111, as well as the horizontal positions of elements of the front flap kicker assembly 113 and the squaring and conveying assembly 114. Two right-hand threaded horizontal adjustment shafts 22, mounted in the frame 101 in a manner that allows them to rotate, are each screwed through two right-hand tapped horizontal adjustment blocks 23. Each shaft 22 has attached at one end a right-hand tapped nut 24, and at the other end a large horizontal adjustment sprocket 21. Two left-hand threaded horizontal adjustment shafts 25, mounted in the frame 101 in a manner that allows them to rotate, are each screwed through two left hand tapped horizontal adjustment blocks 26. Each shaft 25 has attached at one end a left-hand tapped nut 35, and at the other end a small horizontal adjustment sprocket 27. A horizontal adjustment chain 20 is threaded around and engaged with the sprockets 21 and 27. One of the shafts 22 has a bevel gear 28 attached to it. An adjustment transfer shaft support 37 is attached to the frame 101 and supports an adjustment transfer shaft 30 in a manner that allows it to rotate. The shaft 30 has a second gear 28 attached to it. The gear 28 attached to the shaft 22 meshes with the gear 28 attached to the shaft 30. Three right-hand threaded vertical adjustment shafts 32 and a left-hand threaded vertical adjustment shaft 34 are attached to the frame 101 via four flange bearings 36. The shafts 32 and 34 are screwed through two tapped magazine support bars 33. Each of the shafts 30, 32 and 34 has a vertical adjustment sprocket 29 attached to it. A vertical adjustment chain 31 is threaded around and engaged with the five sprockets 29.

Turning to FIG. 4A, in order to adjust the machine for a larger case, one of the nuts 24 is rotated clockwise using a wrench (not shown), causing the shafts 22 and 25 to rotate simultaneously as they are driven by the sprockets 21 and 27 and the chain 20. The shafts 25 rotate counterclockwise and at twice the rate of the shafts 22, due to the sprockets 21 having twice the teeth of the sprockets 27. The blocks 23 and 26 travel laterally on shafts 22 and 25 away from the sprockets 21 and 27, the blocks 26 traveling at twice the rate of the blocks 23. The shaft 30 is simultaneously rotated counterclockwise via the gears 28, causing the sprockets 29 to rotate via the chain 31. The shafts 32 are caused to rotate clockwise and the shaft 34 is caused to rotate counter clockwise, causing the bars 33 to travel downwards on shafts 32 and 34 at the same rate of travel as the blocks 23.

Attached to the blocks 26 is the carrier 75, which in turn has attached to it the components described earlier, including the drive belt 63 and the squaring arm 84. As the adjustment continues, the drive belt 63 travels away from the drive belt 58. When the distance between the belts 58 and 63 equals the width of the case blank 94 to be processed, this adjustment is complete. The squaring arm 84 is simultaneously automatically positioned for proper orientation with the lead case blank 94. Attached to the blocks 23 are the carrier tubes 38, which in turn have attached to them the front flap kicker assembly 113. Due to the mechanical relationship between the blocks 23 and 26, the position of the front flap kicker assembly 113 is simultaneously automatically maintained centered between the belts 58 and 63 as the adjustment is made.

As the machine is adjusted to process a case blank 94 of a different width, the folded bottom of the case blank 94 must be maintained at a constant horizontal level. The length of the bottom flaps 94D and 94E increases at half the rate of the width of the case blank 94. Thus, the horizontal level of the magazine assembly 111 must be lowered at half the rate of travel of the drive belt 63 to maintain the folded bottom of the case blank 94 at the same horizontal position regardless of the case width. The magazine assembly 111 is mounted on top of the bars 33, which are the means for vertical adjustment via which the magazine assembly 111 is affixed to the frame 101. Due to the mechanical relationship between the blocks 26 and the bars 33, the position of the magazine assembly 111 is simultaneously automatically maintained at the proper horizontal level as the adjustment is made.

The left magazine side rail 93 is adjusted via the adjustment mechanism (not shown) mentioned earlier to accommodate the overall width of the flattened case blank 94.

The rear flap kicker assembly 112 is adjusted towards or away from the squared case blank 94, via the adjustment mechanism (not shown) mentioned earlier. The rear flap kicker assembly 112 is positioned such that the rear flap kicker 43 is adjacent to the rear bottom minor flap 94D of the squared case blank 94.

At this point, the machine has been changed over and is ready to run the newly selected size case blank 94.

FIGS. 2A–2F and FIGS. 3A–3F show the steps involved in one complete cycle of the machine.

Figure 2A:
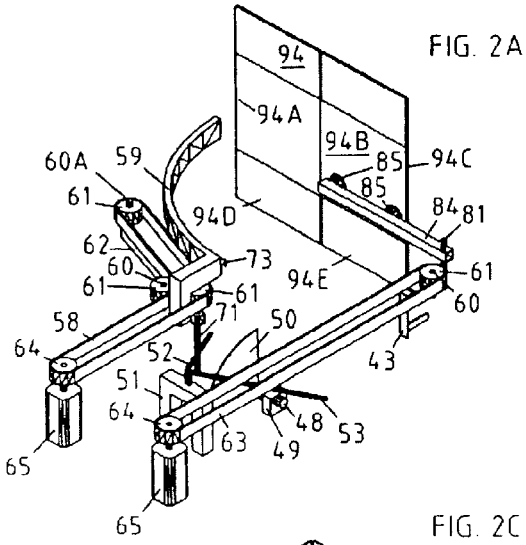
FIGS. 2A through 2F are a first set of sequential perspective views of the steps involved in one cycle of the machine.
Figure 3A:
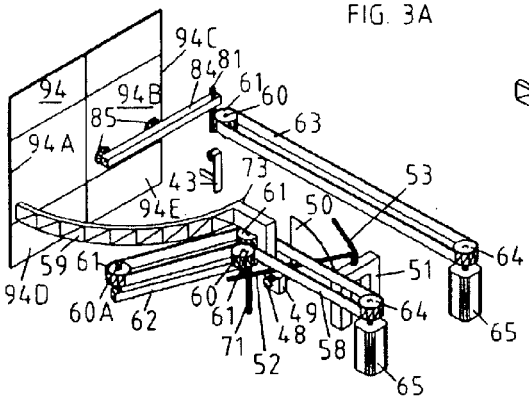
FIGS. 3A through 3F are a second set of sequential perspective views of the steps involved in one cycle of the machine.

Turning to FIGS. 2A and 3A, the machine is shown with all mechanisms in their starting positions. The cycle begins with activation of the vacuum source (not shown), which applies a vacuum to the suction cups 85, the case-gripping means which in turn grips the first major side panel 94B of the lead case blank 94.

Figure 2B:
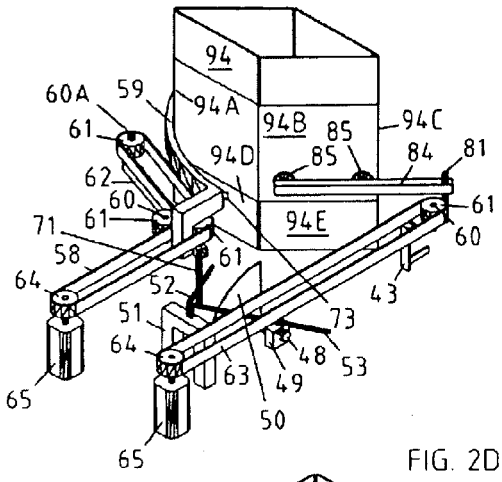
Figure 3B:
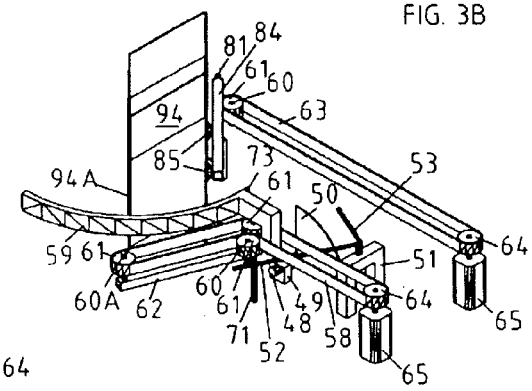

Turning to FIGS. 2B and 3B, in the next step of the cycle, the rod of the squaring arm cylinder 77 extends as described earlier and the squaring arm 84 begins rotating counterclockwise (shown approximately halfway through its travel), bringing with it the lead case blank 94 which is held by the suction cups 85. As this occurs, the outer corner 94A comes into contact with the internal vertical surface of the squaring rail 59. Do to the curved shape of the rail 59, the distance between its internal vertical surface and a vertical plane represented by the outer corner 94C gradually decreases as the case blank 94 rotates. The outer corner 94A is gradually forced towards the outer corner 94C, causing the case blank 94 to expand into a parallelogram.

Figure 2C:
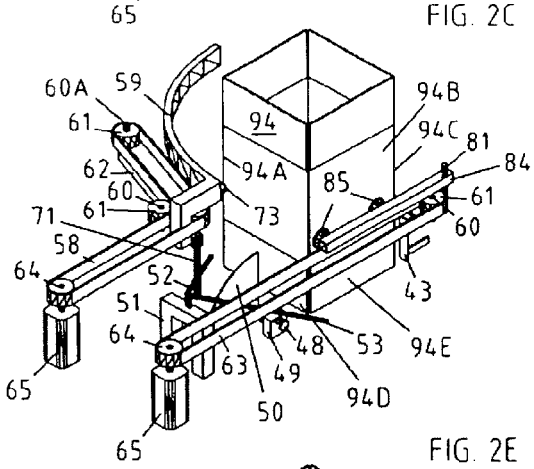
Figure 3C:
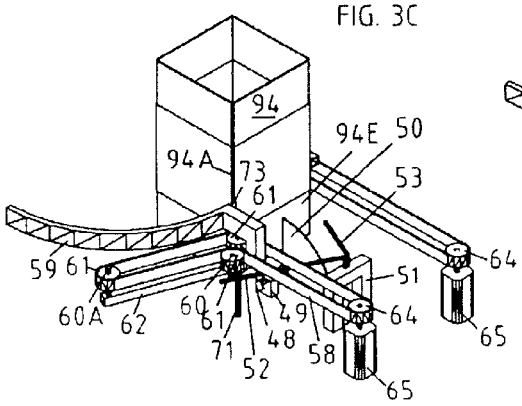

Turning to FIGS. 2C and 3C, the squaring arm 84 has reached the end of its travel at 90 degrees of rotation and the lead case blank 94 has been forced into a rectangular or "squared" configuration. The outer corner 94A travels beyond the end of the squaring rail 59 and into contact with the case retention spring 73, which retains the case blank 94 in its current position against its tendency to return to its flattened state. The major side panel 94B is brought into contact with the drive belt 63.

Figure 2D:
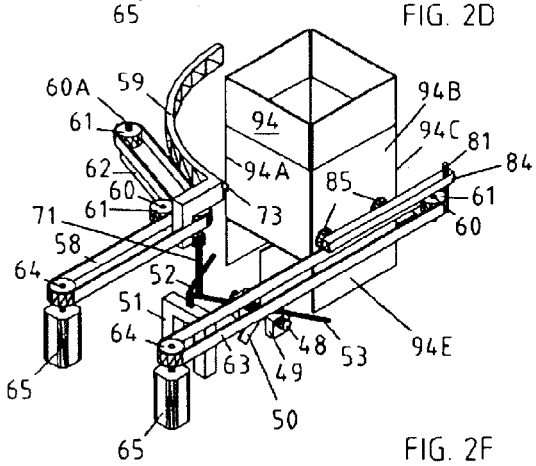
Figure 3D:
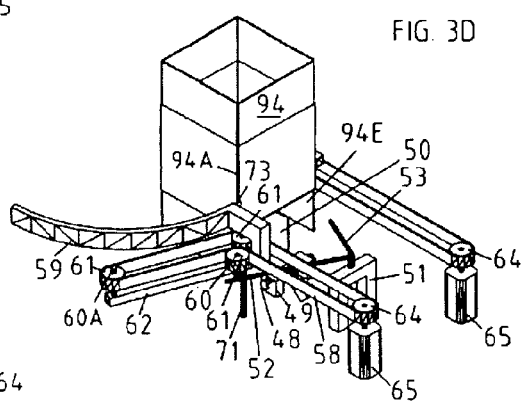

Turning to FIGS. 2D and 3D, in the next step of the cycle, the rods of the kicker cylinders 41 and 46 extend, rotating the flap kickers 43 and 50, as described earlier, closing the front and rear bottom minor flaps 94D.

Figure 2E:
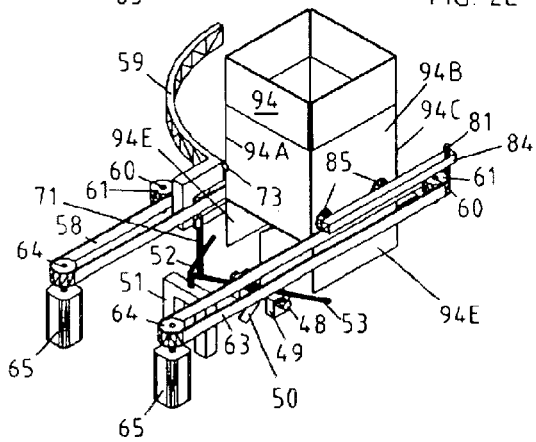
Figure 3E:
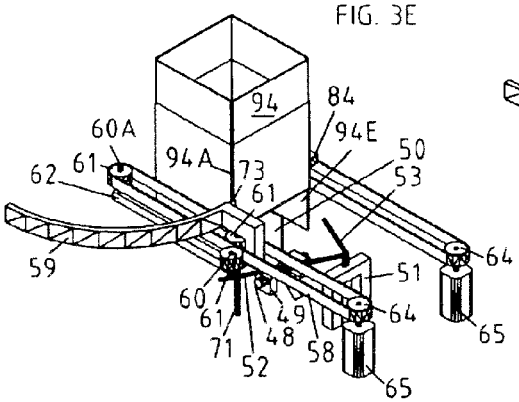

Turning to FIGS. 2E and 3E, in the next step of the cycle, the rod of the swing arm cylinder 68 extends, rotating the arm 70, and all attached elements including the belt 58, as described earlier, until the drive belt 58 rests against the major side panel opposite the first major side panel 94B. At this point, the case blank 94 is gripped between the gate-like swinging section of drive belt 58 and the fixed case drive belt 63, and is ready to be conveyed by drive belts 58 and 63.

Figure 2F:
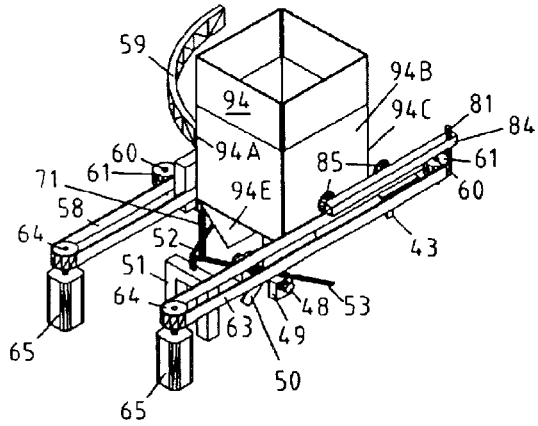
Figure 3F:
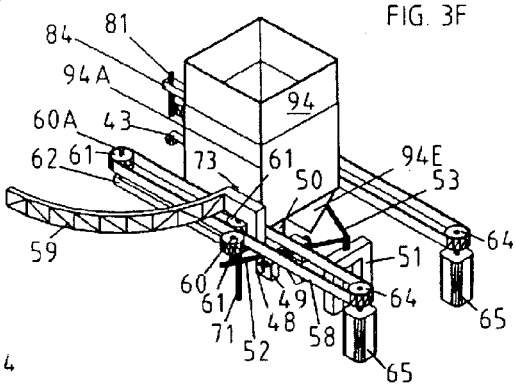

Turning to FIGS. 2F and 3F, in the next step of the cycle, the belt drive motors 65 are energized simultaneously, causing the drive belts 58 and 63 to rotate as described earlier. The case blank 94 is conveyed by the drive belts 58 and 63, towards the belt drive motors 65. The case blank 94 forces the case retention spring 73 to deflect out of its path. The bottom major flaps 94E of the case blank 94 are carried into and over the flap ploughs 52 and 53, which force them to fold upwards.

As the case blank 94 is conveyed past and clear of the squaring arm 84, the rod of the squaring arm cylinder 77 retracts and rotates the squaring arm 84, and all attached elements, clockwise back to their starting positions. As the case blank 94 is conveyed past and clear of the case retention spring 73, the rod of the swing arm cylinder 68 retracts, rotating the arm 70 and all attached elements, including the belt 58, counterclockwise back to their starting positions. The rods of the kicker cylinders 41 and 46 retract, rotating the flap kickers 43 and 50 back to their starting positions. The machine has now returned to the state shown in FIGS. 2A and 3A and is ready for another cycle.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method for squaring flattened case blanks in preparation for use comprising the steps of:

providing a plurality of flattened case blanks, each case blank having a minimum of a first major side panel, a first outer folded corner adjacent to said first major side panel, a second outer folded corner on the opposite end of the case blank from said first outer folded corner, two bottom major flaps, and two bottom minor flaps;

gripping said first major side panel of the lead case blank of said plurality of flattened case blanks, leaving the remaining three side panels free to rotate about the axes represented by the four folded corners of said lead case blank;

rotating said first major side panel and subsequently, said lead case blank, away from said plurality of flattened case blanks about an axis which is parallel to and adjacent to a line represented by said first outer folded corner of said lead case blank; and putting the edge of said lead case blank, comprised of said second outer folded corner, into contact with a fixed curved member as said first major side panel is rotated, causing the distance between said outer folded corners to gradually decrease until said lead case blank is forced into a squared configuration as the degree of rotation of said first major side panel reaches substantially 90 degrees.

2. A method for squaring flattened case blanks in preparation for use as claimed in claim 1 further comprising the step of folding the bottom major and minor flaps of the squared lead case blank.

3. A method for squaring flattened case blanks in preparation for use as claimed in claim 2 further comprising the step of conveying said squared lead case blank out of the squaring area.

4. A mechanism for squaring flattened case blanks in preparation for use comprising:

a plurality of flattened case blanks, each case blank having a minimum of a first major side panel, a first outer folded corner adjacent to said first major side panel, a second outer folded corner on the opposite end of the case blank from said first outer folded corner, two bottom major flaps, and two bottom minor flaps;

a first means for gripping the lead case blank of said plurality of flattened case blanks by said first major side panel of said lead case blank, leaving the remaining three side panels free to rotate about the axes represented by the four corners of said lead case blank;

a second means for rotating said first major side panel and subsequently, said lead case blank, away from said plurality of flattened case blanks about an axis which is parallel to and adjacent to a line represented by said first outer folded corner of said lead case blank adjacent to said first major side panel; and a structure, placed in the path of the rotating lead case blank and making contact with said second outer folded corner of said rotating lead case blank, formed in such a manner that it causes the distance between said outer folded corners to gradually decrease as said rotating lead case blank rotates until said rotating lead case blank is forced into a squared configuration as the degree of rotation of said first major side panel reaches substantially 90 degrees.

5. A mechanism for squaring flattened case blanks in preparation for use as claimed in claim 4 wherein said first means comprises suction cups and a vacuum source.

6. A mechanism for squaring flattened case blanks in preparation for use as claimed in claim 5 wherein said second means comprises a pivotally mounted arm.

7. A mechanism for squaring flattened case blanks in preparation for use as claimed in claim 6 further comprising a member with a third means for horizontal adjustment to which said second means is affixed, and a member with a fourth means for vertical adjustment by which said plurality of flattened case blanks is supported, said third means being mechanically coupled to said fourth means.

8. A mechanism for squaring flattened case blanks in preparation for use as claimed in claim 7 further comprising a fifth means for closing said bottom major and minor flaps of the squared case.

9. A mechanism for squaring flattened case blanks in preparation for use as claimed in claim 8 further comprising a sixth means for conveying said squared case out of the squaring area.

10. An apparatus for squaring flattened case blanks in preparation for use comprising:

a magazine, affixed to a frame via a means for vertical adjustment, containing a plurality of flattened case blanks, each case blank having a minimum of a first major side panel, a first outer folded corner adjacent to said first major side panel, a second outer folded corner on the opposite end of the case blank from said first outer folded corner, two bottom major flaps, and two bottom minor flaps;

a pivotally mounted arm, affixed to a horizontal carrier adjustably affixed to said frame, the adjustment means of which is mechanically linked to the means for vertical adjustment of the height of said magazine, for removal of said lead case blank in said magazine, said pivotally mounted arm rotating about an axis which is parallel to and adjacent to a line represented by said first outer folded corner of said lead case blank;

a case-gripping means comprising suction cups and a vacuum source, positioned to grip said first major side panel, affixed to said pivotally mounted arm;

a member, affixed to said frame on the side of said lead case blank opposite the side to which said pivotally mounted arm is affixed, formed in such a manner that a plane representing its internal vertical surface is perpendicular to the face of said lead case blank at the end adjacent to said lead case blank and parallel to said face of said lead case blank at the opposite end, which said lead case blank makes contact with and is squared by as said lead case blank is rotated away from said magazine by said pivotally mounted arm;

bottom flap-folding means to close said bottom major and minor flaps of the squared case; and means for conveying said squared case out of the squaring area comprising a first drive belt, positioned to contact said first major side panel of said squared case, affixed to said horizontally adjustable carrier on which said squaring arm is mounted, and a second drive belt, containing a gate-like swinging section, positioned to contact the major side panel opposite said first major side panel of said squared case, affixed to said frame.

* * * * *